US009812763B2

(12) United States Patent
Singer

(10) Patent No.: US 9,812,763 B2
(45) **Date of Patent: *Nov. 7, 2017**

(54) VARIABLE ANGLE MOUNT FOR ATTACHING A MAST TO A STRUCTURE

(71) Applicant: DISH Network L.L.C., Englewood, CO (US)

(72) Inventor: Glen Singer, Bloomfield, NM (US)

(73) Assignee: DISH Network LLC, Englewood, CO (US)

( * ) Notice: Subject to any disclaimer, the term of this patent is extended or adjusted under 35 U.S.C. 154(b) by 371 days.

This patent is subject to a terminal disclaimer.

(21) Appl. No.: 14/057,795

(22) Filed: Oct. 18, 2013

(65) Prior Publication Data

US 2014/0166841 A1 Jun. 19, 2014

Related U.S. Application Data

(63) Continuation of application No. 12/210,009, filed on Sep. 12, 2008, now Pat. No. 8,564,498.

(51) Int. Cl.
*H01Q 1/12* (2006.01)

(52) U.S. Cl.
CPC ..... *H01Q 1/1264* (2013.01); *H01Q 1/1221* (2013.01); *Y10T 29/49016* (2015.01)

(58) Field of Classification Search
CPC ..... H01Q 1/1221; H01Q 1/1264; Y10T 29/49016
USPC ..... 343/840, 912, 878, 882, 715, 765; 248/415, 288.31
See application file for complete search history.

(56) References Cited

U.S. PATENT DOCUMENTS

| | | | | |
|---|---|---|---|---|
| 4,134,121 | A * | 1/1979 | Northcutt | H01Q 1/20 343/715 |
| 4,498,410 | A | 2/1985 | Budge | |
| 5,614,918 | A | 3/1997 | Dinardo et al. | |
| 5,664,750 | A | 9/1997 | Cohen | |
| 6,075,499 | A * | 6/2000 | Edwards | H01Q 3/08 343/878 |
| 6,460,821 | B1 | 10/2002 | Rhudy et al. | |
| 6,466,181 | B1 * | 10/2002 | Ho | H01Q 1/1207 343/765 |
| 8,564,498 | B2 * | 10/2013 | Singer | H01Q 1/1221 343/882 |

OTHER PUBLICATIONS

Scott, Damian, DISH Network Service Corporation, "Installing a Dish 500 Using a Uni-Mount Kit," Oct. 28, 2005; retrieved from the Internet Jun. 13, 2008 at http://web.njit.edu/~das38/.

* cited by examiner

*Primary Examiner* — Lam T Mai
(74) *Attorney, Agent, or Firm* — Lorenz & Kopf, LLP

(57) ABSTRACT

Mounting systems and apparatus are provided for attaching a mast to a structure at a desired orientation. The mounting apparatus includes a base support and a ball mount. The base support can be rigidly attached to a portion of the structure. The ball mount receives a ball associated with the mast to thereby allow the mast to be positioned and maintained at the desired orientation. The mounting apparatus may be used, for example, for attaching a digital broadcast satellite (DBS) antenna to a fascia or other portion of a home or other structure.

20 Claims, 3 Drawing Sheets

VARIABLE ANGLE MOUNT FOR ATTACHING A MAST TO A STRUCTURE

CROSS-REFERENCES TO RELATED APPLICATIONS

This Application claims priority to U.S. non-provisional application Ser. No. 12/210,009, filed Sep. 12, 2008.

TECHNICAL FIELD

The present invention generally relates to methods, systems and structures for mounting a mast, pole or similar structure to another object. Various embodiments may be used, for example, in mounting a mast supporting a satellite antenna or the like to a home or other structure.

BACKGROUND

Most television viewers now receive their television signals through a content aggregator such as a cable or satellite television provider. For subscribers to a direct broadcast satellite (DBS) service, for example, television programming is received via a broadcast that is sent via a satellite to an antenna that is generally located on the exterior of a home or other structure. Often, the antenna is mounted to a fascia or other portion of a roof associated with the structure.

Challenges in installing such antennas can arise, however, due to the wide variety of homes and other structures that may desire DBS service. Homes and other buildings may have widely varying roofing structures, roofing pitches, and/or other features, for example, that can make antenna installations difficult. Other locations on and around the home can present similar installation challenges in that it may be difficult to place the antenna at a desired operating orientation while maintaining a solid mechanical mount to the home or other structure.

Various attempts have been made to create universal mounting brackets for mounting antenna masts to homes and other structures, but many of these brackets have exhibited certain disadvantages. Conventional fascia mounts, for example, typically provide a flat metal plate with various holes that can be bolted or otherwise fastened to the structure and to the antenna base. Such mounts are typically designed to be maintained in an approximately vertical position, however, after being bolted to the fascia of the structure; that is, they are not designed to be installed in an orientation other than vertically. In environments with relatively small fascias, relatively sharp roof pitch, and/or other irregularities, the limited orientation options may preclude fastening the bracket to the fascia or other portion of the structure as securely as may be desired. That is, some portion of the vertically-positioned plate may extend beyond the edge of the fascia, thereby making any holes on that portion unavailable for supporting bolls or other fasteners to the structure. If the bracket is not securely fastened, wind or other environmental effects may create vibrations or loosen the mount over time. In some cases, these effects can degrade or interrupt signal reception, thereby leading to annoyance to the customer, as well as undesired maintenance or repair calls for the vender.

It is therefore desirable to create systems, structures and methods for securely mounting antenna masts to a variety of homes or other structures. These and other desirable features and characteristics will become apparent from the subsequent detailed description and the appended claims, taken in conjunction with the accompanying drawings and this background section.

BRIEF SUMMARY

Various systems and methods and methods allow for attaching a mast to a structure at a desired orientation. In some embodiments, a mounting apparatus for attaching a mast to a structure at a desired orientation is provided. The mounting apparatus of this embodiment suitably comprises a base support configured to attach to the structure, as well as a ball mount that is attached, integrally formed or otherwise affixed to the base support. The ball mount is configured to receive a ball associated with the mast to thereby allow the mast to be positioned and maintained at the desired orientation.

Other embodiments provide a system for attaching a satellite antenna to a structure at a desired orientation. A mast comprising a first end and a second end is provided, wherein the first end is attached to the satellite antenna. A ball is located at the second end of the mast. A mounting apparatus comprises a base support configured to rigidly attach to the structure and a ball mount configured to receive the ball to thereby allow the mast to be positioned and maintained in the desired orientation.

Still other embodiments provide a method of installing a satellite antenna on a mast to a fascia of a structure using a mounting apparatus. The mounting apparatus comprises a base support having a long axis and a ball joint configured for receiving a ball associated with the mast. The mounting apparatus is affixed to the structure such that the long axis of the base support substantially aligns with the fascia of the structure. The ball associated with the mast is adjusted in the ball joint to thereby place the mast in a desired orientation. The ball joint is then tightened to thereby maintain the mast in the desired orientation.

Various other embodiments, aspects and other features are described in more detail below.

BRIEF DESCRIPTION OF THE DRAWING FIGURES

Exemplary embodiments will hereinafter be described in conjunction with the following drawing figures, wherein like numerals denote like elements, and FIGS. 1 and 2 are perspective and side views, respectively, of an exemplary mounting system for a satellite antenna or the like;

DETAILED DESCRIPTION

The following detailed description of the invention is merely exemplary in nature and is not intended to limit the invention or the application and uses of the invention. Furthermore, there is no intention to be bound by any theory presented in the preceding background or the following detailed description.

According to various exemplary embodiments, a mounting apparatus for attaching a mast or similar structure to a building or other object is provided with a ball-and-socket-type joint that allow relative motion of a base support and a ball affixed to the mast. By providing the ability to move the mast with respect to the base support within the ball joint, the base support can be angled or otherwise positioned as desired for a solid mount against a fascia or other portion of a structure while still providing the ability to position the antenna mast at a desired orientation for effective operation.

While the exemplary embodiments described herein generally refer to mounting a satellite antenna to a fascia of a building structure, equivalent concepts could be used in any number of other settings. The antenna mast could equivalently represent an RF antenna, a flag pole, a support for a banner or sign, or other any other mast-type structure, any of which could be equivalently mounted to any sort of building, pole, tree, furniture, structure, and/or other object that may be appropriate for the particular setting and embodiment. Still further, mounts need not be applied to the fascias of structures or other objects, but could be equivalently applied to any sort of roof, overhang, eave, wall and/or any other substantially unyielding portion of the object depending upon the particular embodiment.

As noted above, conventional mounting brackets generally lack any substantial ability to adjust the position of the mast with respect to the bracket face. While some brackets have allowed limited motion in one direction (e.g, "up/down"), this limited movement does not allow the bracket to be installed in an orientation that is not vertical. That is, the bracket can typically only take a single, vertical orientation with respect to the object if desired orientation of the mast is to be maintained. By allowing motion in another dimension (e.g., with a ball joint that provides two degrees of movement freedom), the base support can be mounted at virtually any angle with respect to the mounting surface. That is, the base support can be oriented approximately parallel or otherwise in a direction that allows for solid mounting, without sacrificing the ability to maintain the mast (and consequently an antenna or other object attached to the mast) in a vertical or other desired orientation.

Figure 1:
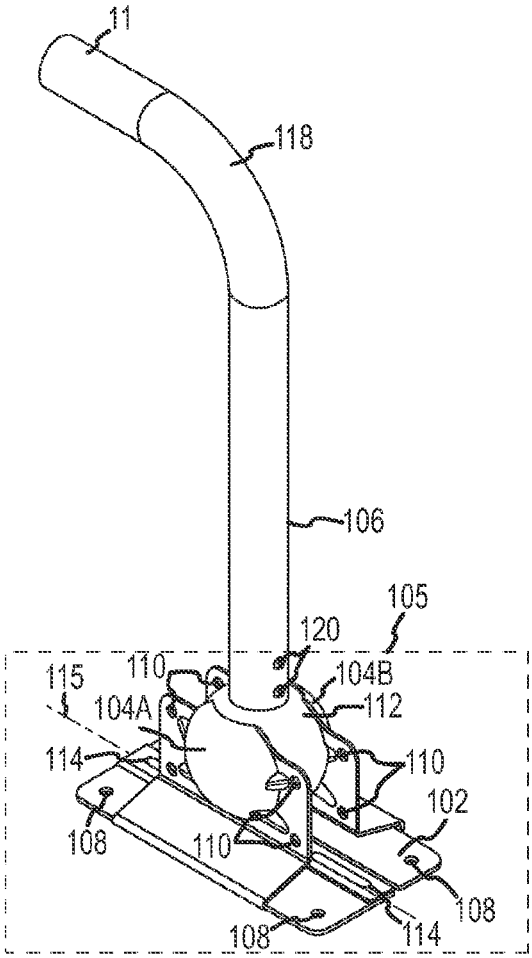

Turning now to the drawing figures and with initial reference to FIG. 1, an exemplary mounting apparatus 105 for attaching a mast 106 to an object suitably includes a base support 102 and a ball mount 104. Base support 102 is suitably attached to the object, and ball mount 104 receives a ball 112 that is associated with the mast 106. Mast 106 can be positioned by adjusting the joint formed by ball 112 and ball mount 104 as desired to maintain the mast 106 at a vertical or other desired orientation.

Base support 102 is any plate, face or other support capable of attaching to a building structure or other appropriate object. In various embodiments, base support 102 includes one or more rigid plates similar to a bracket or the like that can be positioned to be relatively flush against a building fascia or other mounting surface. Holes may be formed in base support 102 as appropriate to allow base support 102 to be fastened to the mounting surface using any sort of conventional fasteners, such as screws, bolls, nails and/or the like. FIG. 1, for example, shows a base support 102 with several holes 108 for receiving fasteners that may attach base support 102 to the mounting surface as desired. In this embodiment, four holes 108 are shown located near the corners of the base support 102. Other embodiments may include any number of holes 108 that are placed at any location. Any of these holes 108 may be supplemented and/or modified in any manner to accommodate any types of fasteners and/or the like.

FIG. 1 also shows two slots 114. These slots 114 are shown as being elongated to accommodate a screw, bolt, nail or other fastener at any point along with length of the slot. Such a feature may be used, for example, to allow placement of base support 102 with respect to a stud or other substantially rigid portion of the mounting structure. That is, one or more fasteners may be placed anywhere along the length of one or more slots 114 to facilitate insertion into a stud or other rigid portion of the mounting structure, thereby further improving the strength and rigidity of the mount.

Mounting apparatus 105 further includes a ball mount 104 that is joined to base support 102 in any manner. Ball mount 104 may be separately formed from base support 102, for example, and then joined by welding, riveting, bolting and/or any other technique. In other embodiments, ball mount 104 and base support 102 are joined in the sense of being integrally formed with each other, as shown in FIG. 2.

Ball mount 104 is any structure or support capable of receiving a ball 112 associated with mast 106. In the exemplary embodiment shown in FIG. 1, ball mount 104 includes two portions 104A-B that extend approximately orthogonally from base support 102 and that are shaped to receive ball 112 as appropriate. Ball mount 104 is further shown with any number of holes 110 for accommodating bolts or other tightening mechanisms, as described more fully below.

Figure 2:
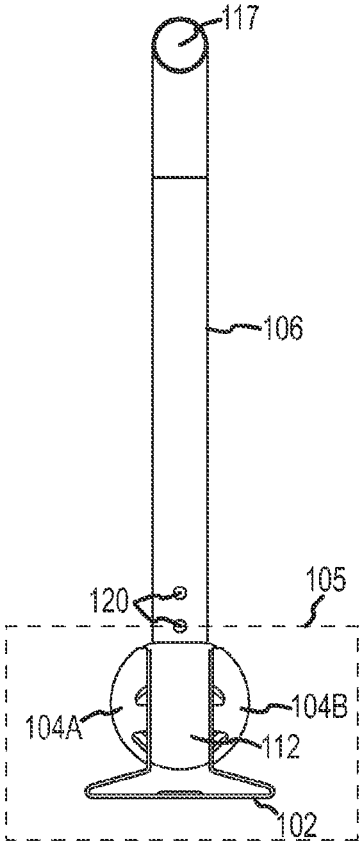

Referring to FIGS. 1 and 2, mast 106 is associated with a ball 112 at one end. The other end 117 of mast 106 may be attached to an antenna, flag or the like, as desired. In various embodiments, mast 106 includes a bend 118 or other feature that allows for proper positioning of an antenna or other object. Ball 112 may be integrally formed with mast 106 in some embodiments, or may be attached to mast 106 using any sort of joining techniques and structures. In various embodiments, mast 106 contains any number of holes 120 that can be used to accommodate bolts, rivets or other fasteners to any sort of outcropping from a separately-formed ball 112. The mechanical design of mast 106 and ball 112 may be modified in any manner to produce a mast 106 that is associated with a ball 112 that can be received within ball mount 104 of mounting apparatus 105.

In operation, then, mounting apparatus 105 may be attached to any sort of structure as desired. In various embodiments, the base support 102 is designed to be approximately rectangular or trapezoidal with a long axis 115 (FIG. 1) that can be aligned to a mounting surface. If apparatus 105 is to be mounted on a fascia of a home or other structure, for example, the long axis 115 can be aligned in parallel with the roof pitch (or the fascia) of the structure so that most, if not all, of holes 108 can support a fastener into the structure itself, thereby providing a relatively firm mount to the structure. Moreover, in embodiments that include one or more slots 114, a fastener can additionally be placed into a stud or other rigid support, thereby further improving the mount to the structure. The long axis 115 of apparatus 105 can therefore be aligned in a manner that provides for a strong mount without immediate concern for the orientation of mast 106.

The orientation of the mast 106 can then be adjusted, using the ball-and-socket joint, to compensate for the alignment of base support 102. If a vertical or other orientation is desired (e.g., to support a DBS antenna or the like), ball 112 can be positioned within ball mount 104 to allow for positioning as desired. Ball 112 may be held in place in any manner; in various embodiments, bolts though holes 110 may be tightened to increase pressure applied by ball mount 104 on ball 112. Other embodiments may be tightened using any other mechanical structure as appropriate.

Mounting apparatus 105 may be manufactured in any manner. In various embodiments, mounting apparatus 105 is formed from steel or other metal, although equivalent embodiments could be formed from plastic, ceramic, carbon composite or other synthetic or non-synthetic material. The apparatus itself may be formed using conventional techniques, such as pressing, molding, drilling and/or the like. In various embodiments, mounting apparatus 105 is formed from a single component piece that may be bent or otherwise shaped to accommodate both base support 102 and ball mount 104. FIG. 2, for example, shows a side view of a mounting apparatus 105 that can be formed from a single sheet of material, although alternate embodiments (such as the embodiment shown in FIG. 3) may be formed from two or more components that can be joined together in any manner.

Figure 3:
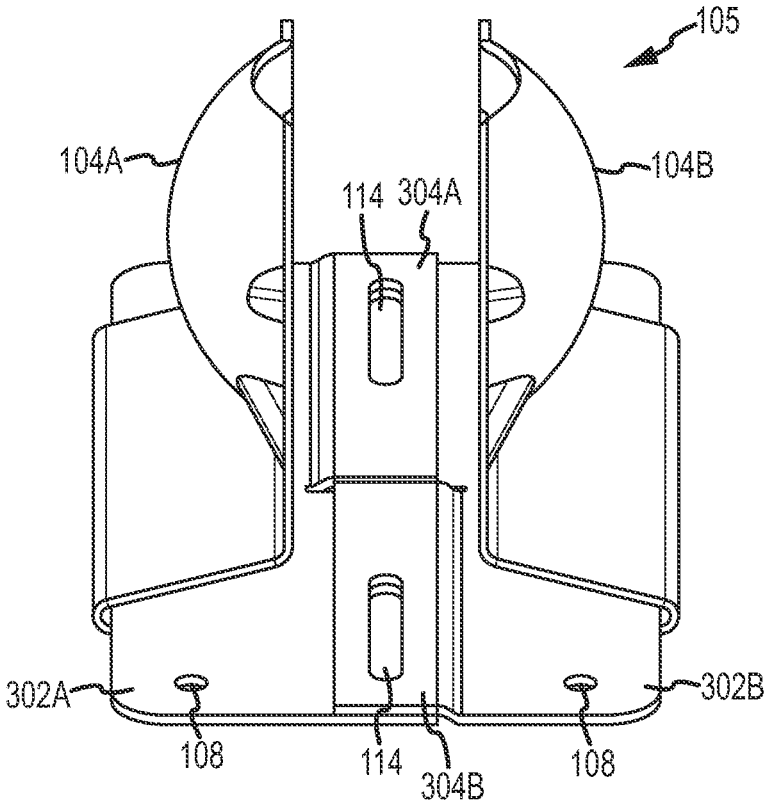
FIG. 3 is a perspective view of an exemplary mast mounting apparatus.

FIG. 3 shows one example of a two-piece structure suitable for use as mounting apparatus 105. Other apparatus 105 may be formed from a single structure, a two-piece structure may be easier to manufacture in some settings. In the embodiment shown in FIG. 3, two sections 302A-B are manufactured to be joined together to create mounting apparatus 105. The two exemplary sections 302A-B are shown to be substantially identical to each other, with each having a region 304 that is designed to extend over a flat portion of the other section to create an overlapping structure. This overlapping portion may accommodate slots 114 described above, or other features as appropriate. The exemplary embodiment shown in FIG. 3 is purely exemplary; other embodiments may be shaped or formed in any other manner, or from any number of separate or integrated components.

Figure 4:
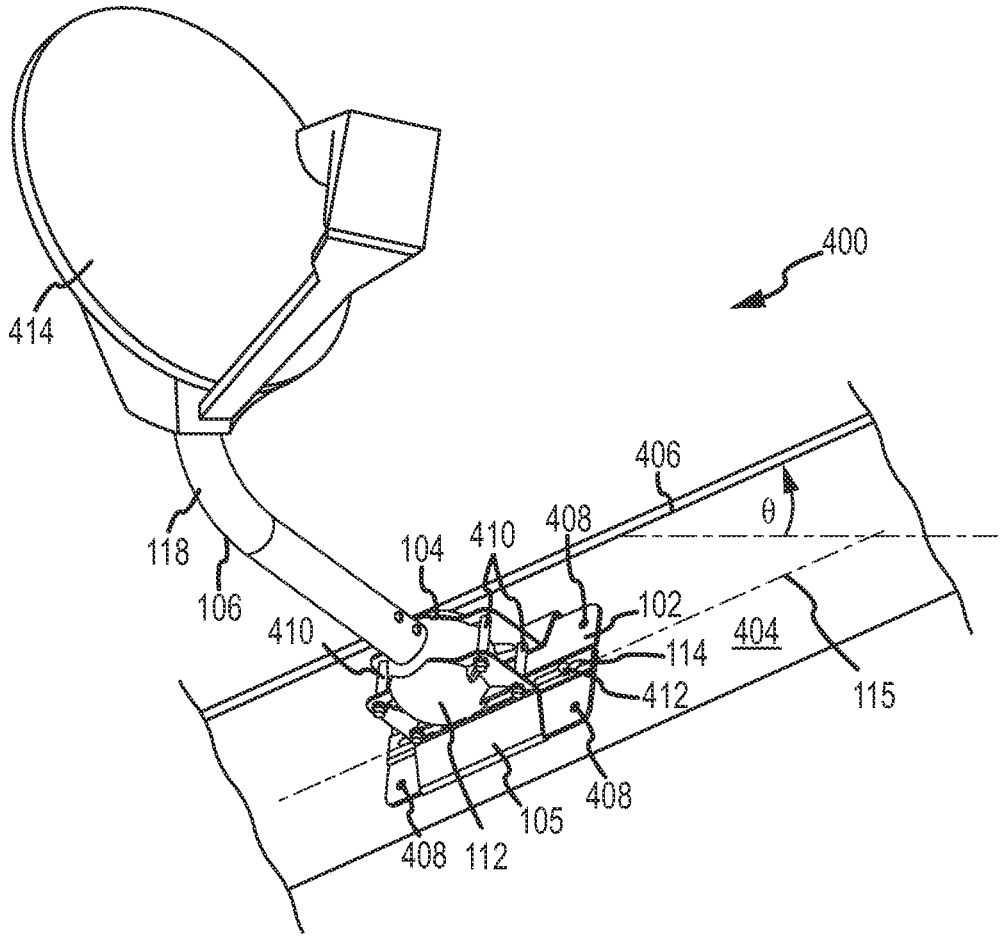
FIG. 4 is a view of an exemplary mounting to a fascia of a building structure.

With reference now to FIG. 4, an exemplary system 400 is shown for mounting a DBS antenna 414 to a building structure. In the exemplary embodiments shown in FIG. 4, the structure has a roof 406 and associated fascia 404 with a pitch angle (θ) to the horizontal. In prior art attempts to mount antenna 414 to fascia 404, the varying sizes and pitch angles of different structures would require specialized brackets, or, more frequently, less than optimum placement of more generic brackets. By accommodating two degrees of movement between base support 102 and mast 106, however, mounting apparatus 105 can be placed on the fascia 404 of the structure such that each of the holes (e.g., holes 108 in FIGS. 1-3) are able to receive fasteners 408 into fascia 404. In the embodiment shown in FIG. 4, for example, this can be accomplished by aligning the long axis 115 of the mounting apparatus 105 to the fascia 404 or roof 406. Stated another way, the long axis of the mounting apparatus 105 can be aligned to match (or at least approximate) the same angle (θ) to the horizontal as the roof pitch of the structure, thereby allowing for very efficient use of available mounting space and providing a much stronger mount to the surface than was previously available. This mount may be made even stronger by placing one or more additional bolts, screws or other fasteners 412 into a stud or other support behind fascia 404 through one or more slots 114, as described above.

Even though the mounting apparatus 105 may not be oriented vertically with respect to the ground, mast 106 may be adjusted as desired using the ball-and-socket joint, as described above. That is, ball 112 may be adjusted within ball mount 104 such that the mast 106 is oriented as desired, accounting for any bend 118 or other features that may be present. When the mast 106 is properly positioned, the position can be maintained by tightening the ball joint as appropriate. In the embodiment shown in FIG. 4, for example, any number of bolts 410 may be placed through holes 110 (FIG. 1) and tightened as desired. Other tightening or holding structures may be used in other embodiments.

After the mast is securely placed, various embodiments will allow the technician to place an antenna 414 or other load on the opposite end 117 of mast 106. As noted at the outset, various embodiments may be used to support DBS antennas, but other equivalent embodiments could support flags, banners, radio antennas, cameras, loudspeakers, or other loads as appropriate.

Using the structures, systems and techniques described herein, then, a more secure mount to a building or other structure can be fashioned. By providing a ball-and-socket joint that provides two degrees of movement between a base support and a mast, the base support can be positioned for a firm mount to the structure while maintaining the mast at a desired orientation.

Unless context dictates otherwise, the term "exemplary" is used herein in the context of an "example", rather than in the context of a "model" that it intended to be duplicated. Similarly, the terms "substantial" and "substantially" are intended to account for minor deviations that nevertheless incorporate the described concept. "Substantially vertical", for example, refers to vertical orientations that are at least predominantly vertical, but that may have some imperfections or other deviations away from perfect vertical orientation due to design or installation tolerances, human actions, variations in manufacturing, design and/or installation, and/or any other factors.

While the foregoing detailed description will provide those skilled in the art with a convenient road map for implementing various embodiments of the invention, it should be appreciated that the particular embodiments described above are only examples, and are not intended to limit the scope, applicability, or configuration of the invention in any way. To the contrary, various changes may be made in the function and arrangement of elements described without departing from the scope of the invention.

What is claimed is:

1. A mounting apparatus for attaching a mast to a fascia of any of a plurality of different structures at a desired orientation, the mounting apparatus comprising:

a base support having a substantially planar face configured to mate with the fascia of one of the different structures for rigid fixation thereto; and a ball mount joined to the base support and configured to receive a ball associated with the mast, wherein the ball moves within the ball mount to thereby allow the mast to move within a substantially cone-shaped region having a central axis that is substantially normal to the substantially planar face of the base support so that the mast is positioned and maintained at the desired orientation with respect to the fascia of the structure.

2. The mounting apparatus of claim 1 wherein the base support comprises a plurality of holes each configured to accept a fastener that attaches the base support to the fascia of the structure.

3. The mounting apparatus of claim 1 wherein the ball mount comprises a substantially circular cutout configured to allow the mast to move within the substantially cone-shaped region.

4. The mounting apparatus of claim 1 wherein the base support comprises an elongated hole configured to be aligned to a substantially solid portion of the fascia of the structure.

5. The mounting apparatus of claim 1 wherein the base support and the ball mount are integrally formed with each other.

6. The mounting apparatus of claim 1 further comprising a fastener configured to tighten the ball-mount with respect to the ball to thereby maintain the ball in a substantially fixed position within the substantially cone-shaped region.

7. The mounting apparatus of claim 1 wherein the ball mount is configured to maintain the mast in a substantially vertical orientation within the substantially cone-shaped region.

8. The mounting apparatus of claim 7 wherein the base support is configured to be oriented in a substantially parallel direction with the fascia while maintaining the mast in the substantially vertical orientation within the substantially cone-shaped region.

9. The mounting apparatus of claim 1 wherein the ball is attached to an end of the mast.

10. The mounting apparatus of claim 1 wherein the ball and the mast are integrally formed with each other.

11. A system for attaching a satellite antenna to any of a plurality of different structures so that the satellite antenna is maintained at a desired orientation regardless of an orientation of a fascia of the structure, the system comprising:

a mast comprising a first end and a second end, wherein the first end is attached to the satellite antenna;

a ball located at the second end of the mast opposite the satellite antenna; and a mounting apparatus comprising a substantially planar base support configured to align with the orientation of the fascia and to rigidly attach to the fascia of the structure and a ball mount configured to receive the ball and to thereby the mast to move within a substantially cone-shaped region having a central axis that is substantially normal to the substantially planar face of the base support so that the mast is positioned and maintained in the desired orientation regardless of the orientation of the fascia of the structure.

12. The system of claim 11 wherein the base support of the mounting apparatus comprises at least one elongated slot configured to align with a substantially rigid portion of the structure.

13. The system of claim 11 wherein the base support of the mounting apparatus comprises a long axis configured to be aligned with the fascia of the structure.

14. The system of claim 13 wherein the mounting apparatus is adjustable so that the mast is maintained in a substantially vertical position within the substantially cone-shaped region even though a long axis of the base support is substantially aligned with the fascia of the structure.

15. The system of claim 11 wherein the mounting apparatus further comprises a fastener configured to tighten the ball mount with respect to the ball to thereby maintain the ball in a substantially fixed position with respect to the ball mount.

16. The system of claim 11 wherein the base support comprises a plurality of fastener holes.

17. The system of claim 16 wherein the base support is configured to be aligned with a fascia of the structure such that each of the plurality of fastener holes is able to receive a fastener to the fascia of the structure.

18. A method of installing a satellite antenna on a mast to a fascia of a structure using a mounting apparatus, wherein the mounting apparatus comprises a base support having a long axis and a ball joint configured for receiving a ball associated with the mast, the method comprising:

affixing the mounting apparatus to the structure such that the long axis of the base support substantially aligns with the fascia of the structure;

adjusting the ball associated with the mast in the ball joint to thereby move the mast within a substantially cone-shaped region having a central axis that is substantially normal to the base support thereby place the mast in a desired orientation regardless of an orientation of the fascia of the structure; and tightening the ball joint to thereby maintain the mast in the desired orientation.

19. The method of claim 18 wherein the base support comprises a plurality of fastener holes, and wherein the affixing comprises aligning the base support such that each of the fastener holes are able to receive a fastener that attaches the base support to the fascia of the structure.

20. The method of claim 18 further comprising attaching the satellite antenna to the mast.

* * * * *